US006212338B1

(12) United States Patent
Hagihara et al.

(10) Patent No.: US 6,212,338 B1
(45) Date of Patent: Apr. 3, 2001

(54) IMAGE FORMING DEVICE WITH COMMUNICATION TO SUPPLEMENTARY TONER CONTAINER

(75) Inventors: Hideaki Hagihara, Nara (JP); Haruo Nishiyama, Colmar; David Isner, Magstatt le Bas, both of (FR); Kenichi Nagata, Shiki-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/537,369

(22) Filed: Mar. 29, 2000

(30) Foreign Application Priority Data

Mar. 30, 1999 (JP) ..... 11-088571

(51) Int. Cl.[7] ..... G03G 15/08; G03G 15/00
(52) U.S. Cl. ..... 399/12; 399/46
(58) Field of Search ..... 399/12, 27, 28, 399/29, 46, 49, 224, 262

(56) References Cited

U.S. PATENT DOCUMENTS 4,912,512 * 3/1990 Midorikawa et al. ..... 399/12
5,184,181 * 2/1993 Kurando et al. ..... 399/262
6,009,293 * 12/1999 Takami ..... 399/227

FOREIGN PATENT DOCUMENTS 4-1682 1/1992 (JP) .
6-19244 * 1/1994 (JP) .
10-161411 6/1998 (JP) .
10-221938 8/1998 (JP) .
11-338329 * 12/1999 (JP) .

* cited by examiner

*Primary Examiner*—Joan Pendegrass
(74) *Attorney, Agent, or Firm*—Dike, Bronstein, Roberts & Cushman, LLP; David G. Conlin

(57) ABSTRACT

Bidirectional communication is carried out between a toner bottle end communication device disposed in a toner bottle and a main body end communication device disposed in a device main body while the toner bottle is moved from a first position where the toner bottle starts being attached to the device main body to a second position where the toner bottle is completely attached. The CPU provided in the main body end communication device decides whether or not the information on the toner bottle received from the toner bottle end communication device matches the device main body, and notifies prior to toner refilling. If the toner bottle is not suitable, the CPU specifies a lower quality image forming condition under which operation conditions for the main charging device, exposure device, and fixing device are changed so as to produce an image of relatively low quality in comparison to normal quality. The user can single out a bogus product among unsuitable toner bottles by identifying a degradation in the quality of the image produced by that condition.

14 Claims, 8 Drawing Sheets

BLOCK DIAGRAM FOR CONTROLS OF TONER BOTTLE

BLOCK DIAGRAM FOR CONTROLS OF DEVICE MAIN BODY

IMAGE FORMING DEVICE WITH COMMUNICATION TO SUPPLEMENTARY TONER CONTAINER

FIELD OF THE INVENTION

The present invention relates to image forming devices, such as a copying machine, a facsimile, and a printer, and in particular to toner cartridges and toner bottles capable of transmitting and receiving information on themselves to and from a device main body, as well as to image forming devices incorporating such toner cartridges and toner bottles.

BACKGROUND OF THE INVENTION

Conventionally, a typical image forming device using an electrophotographic scheme, such as a copying machine, a facsimile, or a printer, has a plurality of developing devices disposed opposite to an image carrier to keep developing agents mixed with predetermined types of toner respectively. By means of the developing devices, the image forming device visualizes a latent image formed on the image carrier. A supplementary toner container, such as a toner cartridge or a toner bottle, is attached externally to a toner supply section of the developing device so as to supply supplementary toner, for example, during maintenance.

It is suggested that an erroneous attaching prevention mechanism should be included in such a supplementary toner container to prevent a supplementary toner container that is unsuitable to the image forming device from being erroneously attached to the device main body of the image forming device. For example, Japanese Laid-Open Patent Application No. 4-1682/1992 (Tokukaihei 4-1682: published on Jan. 7, 1992) discloses such an erroneous attaching prevention mechanism that a bar code reader or other information reading means provided to the toner supply section so as to read a bar code information shown on the toner cartridge activates a misinsertion prevention shutter based on the result of the reading.

Further, a popular, well-known suggestion is such an arrangement that the supplementary toner container is provided with an information storage medium, such as a non-volatie memory, so as to, when attached to a toner supply section, constitute an electric circuit with a developing device and transmit the information stored in the supplementary toner container to the developing device or the device main body by means of electric signals to form a basis on which a decision is made to prevent erroneous attaching.

However, to apply the erroneous attaching prevention mechanism disclosed for use with a toner cartridge in Japanese Laid-Open Patent Application No. 4-1682/1992 (Tokukaihei 4-1682) to an image forming device having a plurality of developing devices disposed opposite to an image carrier, each toner cartridge requires a bar code, and each toner supply section requires information reading means, such as a bar code reader; this arrangement inevitably leads to increases in costs.

Further, the bar code shown on the toner cartridge is susceptible to contamination as a result of direct exposure to developing agent and toner, as well as the bar code reader and other optical information reading means are susceptible to contamination by developing agent and toner; the arrangement therefore suffers from bar code reading errors.

The aforementioned method whereby an electric circuit is formed by the developing device and the supplementary toner container provided with an information storage medium, such as a non-volatile memory, to transmit the information stored in the supplementary toner container by means of electric signals, renders connection points susceptible to contamination as a result of exposure to toner and developing agent, resulting in malfunctioning connection, abrasion, and other undesirable phenomena.

SUMMARY OF THE INVENTION

A solution would be offered by such an arrangement that a unit, including a supplementary toner container, that is attachable to and detachable from an image forming device, can transmit data to and from the main body of an image forming device by means of electric waves. In the arrangement, the supplementary toner container exchanges information with the main body of the device without physical direct contact (contactlessly); therefore, the supplementary toner container is free from the foregoing problems in communication, allowing for more flexibility in design, improved durability, higher efficiency in attaching, smaller dimensions, and lower costs.

However, if the supplementary toner container to be attached has turned out unsuitable for the image forming device as a result of the above data transmission, it is still impossible to decide whether the container is simply manufactured by incompatible specifications or is a bogus product forged by specifications that are similar to those for the supplementary toner container. If the bogus product uses toner of inferior properties, it is likely that the image forming device, as well as the image forming process carried out by the image forming device, is affected negatively; such bogus products need to be singled out and excluded from further use.

In view of the foregoing problems, the present invention has an object to offer an image forming device capable of preventing erroneous attaching of a supplementary toner container to a device main body in a highly reliable manner and also capable of singling out bogus products.

An image forming device in accordance with the present invention includes a device main body to which a supplementary toner container for supplying supplementary toner is attached in a freely attachable and detachable manner, and so as to achieve the foregoing object, the image forming device is characterized in that the supplementary toner container includes container end communication means, having a memory function to store information at least on the supplementary toner container, for contactlessly communicating with main body end communication means disposed in the device main body to transmit the information, and at least a portion, of the supplementary toner container, including the container end communication means is movable from a first position where the supplementary toner container starts being attached to the device main body to a second position where the supplementary toner container is completely attached in readiness for toner refilling, and is able to carry out the communication at least somewhere between the first position and the second position, the image forming device including control means for deciding from a result of the communication whether or not the information on the supplementary toner container matches the device main body, and for specifying an image forming condition that varies depending on the decision whether or not the supplementary toner container is suitable.

According to the arrangement, the container end communication means disposed in the supplementary toner container can communicate with the main body end communication means disposed in the device main body to transmit the information on the supplementary toner container when the portion, of the supplementary toner container, including the container end communication means is somewhere between the first position where the supplementary toner container starts being attached and the second position where the supplementary toner container is completely attached. "Information" here refers to, for example, a manufacturer code and serial number (product lot number) of the supplementary toner container, a name and type of compatible copying machines, printers, facsimiles, and other devices and a color and developing, transfer, and fixing conditions for the toner contained in the supplementary toner container.

Further, the main body end communication means receives the information on the supplementary toner container from the container end communication means through the foregoing communication. Based on a result of the communication, the control means decides whether or not the supplementary toner container is suitable for the device main body, and specifies an image forming condition that varies depending on whether or not the supplementary toner container is suitable. Therefore, if the supplementary toner container is suitable, a normal image forming process is executable by specifying regular image forming conditions.

By contrast, if the supplementary toner container is an unsuitable product, the unsuitability can be readily discovered by specifying a low quality image forming condition under which the image quality is lowered. Consequently, the device main body can be protected from damage and quick wearing due to erroneous use of an unsuitable product over a long period of time. Further, among unsuitable products, especially a bogus product, which is likely to cause a large degradation in image quality, can be singled out.

As a result, an image forming device can be offered with capabilities to prevent erroneous attaching of a supplementary toner container to a device main body in a highly reliable manner and also to single out bogus products.

Preferably, the container end communication means is arranged so as to have another function to update the information on the supplementary toner container and bidirectionally communicate with the main body end communication means.

The space between the first position and the second position is in many cases occupied by nothing else but the supplementary toner container when it is to be attached, and serves no other purposes; transmission errors and jamming with other communication devices can be avoided and a highly reliable communication is ensured, if the bidirectional communication is carried out only in this space.

For a fuller understanding of the nature and advantages of the invention, reference should be made to the ensuing detailed description taken in conjunction with the accompanying drawings.

BRIEF DESCRIPTION OF THE DRAWINGS

FIG. 6(*b*) is a block diagram showing an arrangement of a communication device T2.

DESCRIPTION OF THE EMBODIMENTS

Referring to FIG. 1 to FIG. 8, the following will discuss an embodiment of the image forming device in accordance with the present invention.

Figure 1:
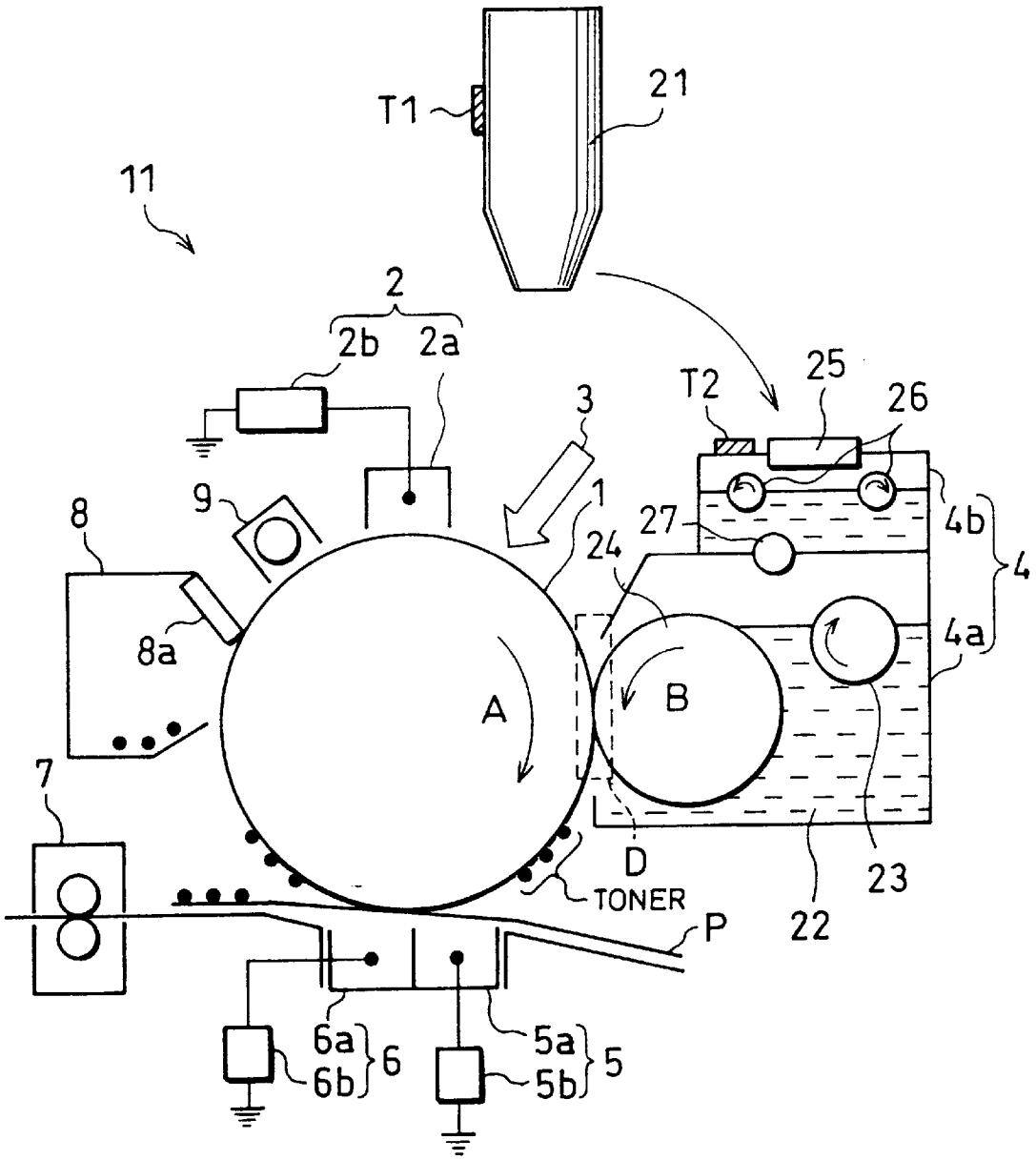
FIG. 1 is a cross-sectional view showing an arrangement of an image forming device of an embodiment in accordance with the present invention.

FIG. 1 shows an arrangement of an image forming device 11 of the present embodiment. The image forming device 11 includes a photosensitive drum 1, a main charging device 2, a light projector 3, a developing device 4, a transfer device 5, a peeling device 6, a fixing device 7, a cleaning device 8, and a discharging device 9.

The photosensitive drum 1 is composed of a metal or resin conductive base body, a bed layer formed on the surface of the conductive base body, and a photosensitive layer formed on the bed layer. The photosensitive layer includes a relatively thin carrier generating layer (CGL) formed on the bed layer and a relatively thin carrier transport layer (CTL) formed as the outermost layer from polycarbonate as a major component. The photosensitive drum 1 is disposed so as to be rotatable in direction A, and carries an electrostatic latent image and a toner image during an image forming process.

The main charging device 2 is constituted by a main charger 2*a*, such as a corona charger or a touch roller charger, and a high voltage supply source 2*b* for supplying electric power to the main charger 2*a*. Receiving a command to start an image forming process, the main charging device 2 uniformly charges the surface of the photosensitive drum 1 until the electric charges reach a predetermined value. Subsequently, the light projector 3 projects light onto the surface, of the photosensitive drum 1, that is charged by the main charging device 2 in accordance with an image. As a result of the exposure to light, carriers are generated in the carrier generating layer of the photosensitive drum 1 and travel through the carrier transport layer. As the carriers reach the surface of the photosensitive layer, they offsets those charges previously supplied by the main charging device 2, so as to achieve a predetermined electrostatic latent image potential.

As the photosensitive drum 1 rotates, the electrostatic latent image formed on the photosensitive drum 1 by the light projector 3 reaches a developing area D that is in direct contact with the developing device 4 which is constituted by a developing tank 4*a* and a toner hopper 4*b*. The developing tank 4*a* is constituted by an agitator 23 for agitating a developing agent 22 that is mixed with toner and a developing agent carrier 24 for feeding the toner. The developing agent carrier 24 rotates in direction B and is pressed against the surface of the photosensitive drum 1. A power supply source (not shown) is connected to the developing agent carrier 24 to supply a predetermined bias voltage to the developing agent carrier 24. The toner hopper 4*b* is constituted by a toner inlet 25 through which supplementary toner is supplied from a toner bottle 21 which will be detailed later, toner transport screws 26 for transporting the supplied supplementary toner, and a toner refilling roller 27 for refilling the developing tank 4*a* with the supplementary toner. The toner carried by the developing agent carrier 24 moves away therefrom and adheres to the surface of the photosensitive drum 1 in the developing area D in accordance with the pattern of the electrostatic latent image. Hence, the electrostatic latent image is visualized, i.e. developed into a toner image.

After development, the toner adhering to the surface of the photosensitive drum 1 moves to a predetermined transfer area. A transfer material P, such as a sheet of paper, is transported to the transfer area by paper feeding means (not shown), and comes in contact with the toner image in synchronism on the photosensitive drum 1. The transfer device 5, being constituted by a transfer charger 5*a* of a charger or touch roller type and a high voltage supply source 5*b* for supplying an electric power to the transfer charger 5*a*, transfers the toner image on the photosensitive drum 1 onto the transfer material P by charging the back side of the transfer material P to an electric potential of a predetermined polarity.

The transfer material P is electrostatically attracted to the surface of the photosensitive drum 1 for the toner image to be transferred, and thereafter peeled off by the peeling device 6. The peeling device 6, being constituted by a peeling charger 6*a* of a charger or touch roller type and a high voltage supply source 6*b* for supplying an electric power to the peeling charger 6*a*, discharges the transfer material P and peels it off the photosensitive drum 1, by charging the back side of the transfer material P onto which the toner image is already transferred to an electric potential of a predetermined polarity. The peeled transfer material P is transported to the fixing device 7 constituted by a pressure applying roller and a heating roller where transfer material P is pressed and heated so that the toner melts with heat and fixes on the transfer material P. After the toner has fixed, the transfer material P is ejected from the device.

After the transfer process, the remaining toner on the surface of the photosensitive drum 1 is collected by means of the cleaning device 8 that is provided so that the cleaning blade 8*a* moves on the surface of the photosensitive drum 1. Thereafter, the remaining electric charges on the surface of the photosensitive drum 1 are removed by the discharging device 9 that is constituted by a light discharge lamp or a touch discharger to electrically initialize the surface of the photosensitive drum 1 to complete a cycle of the image forming process.

Next, taking the toner bottle 21 as an example of a supplementary toner container, the following description will discuss attaching of a supplementary toner container. The same description holds with other types of toner cartridges that are attached in similar manners.

Figure 3:
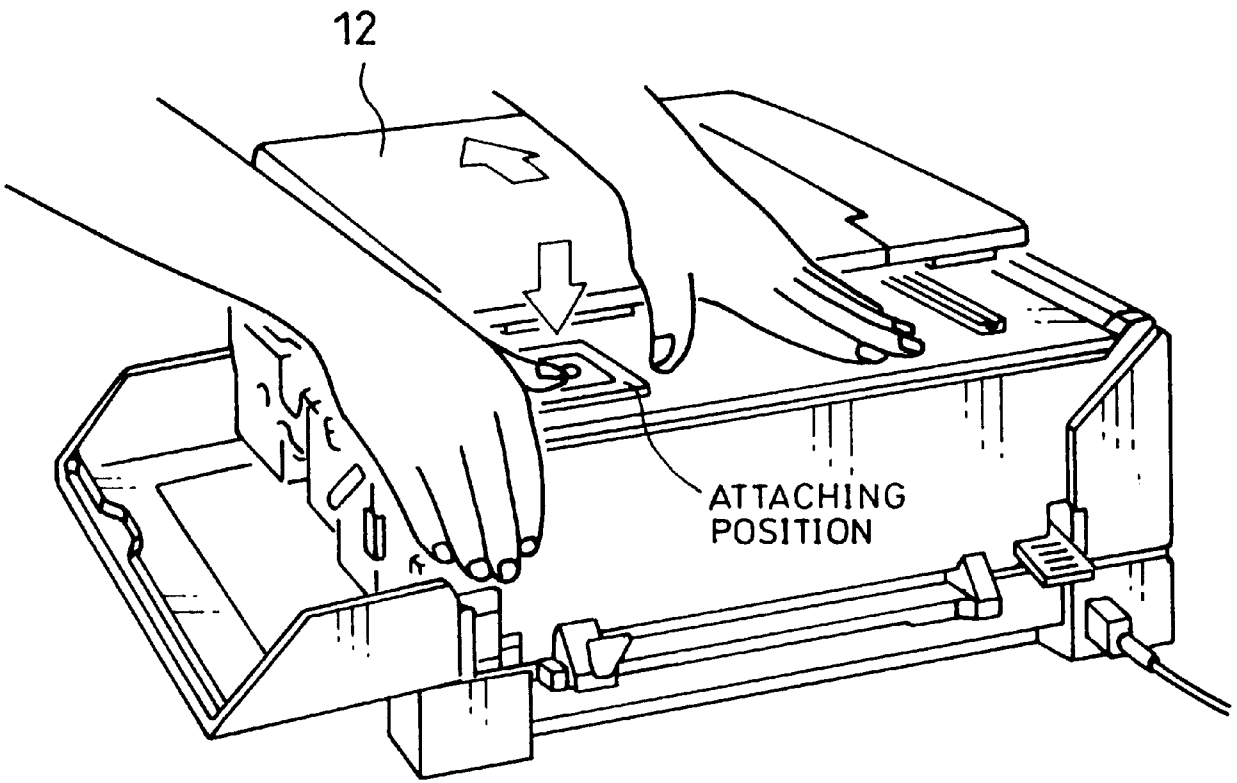
FIG. 3 is a perspective view illustrating, as an example, a position where the toner bottle is attached to the image forming device illustrated in FIG. 1.
Figure 4:
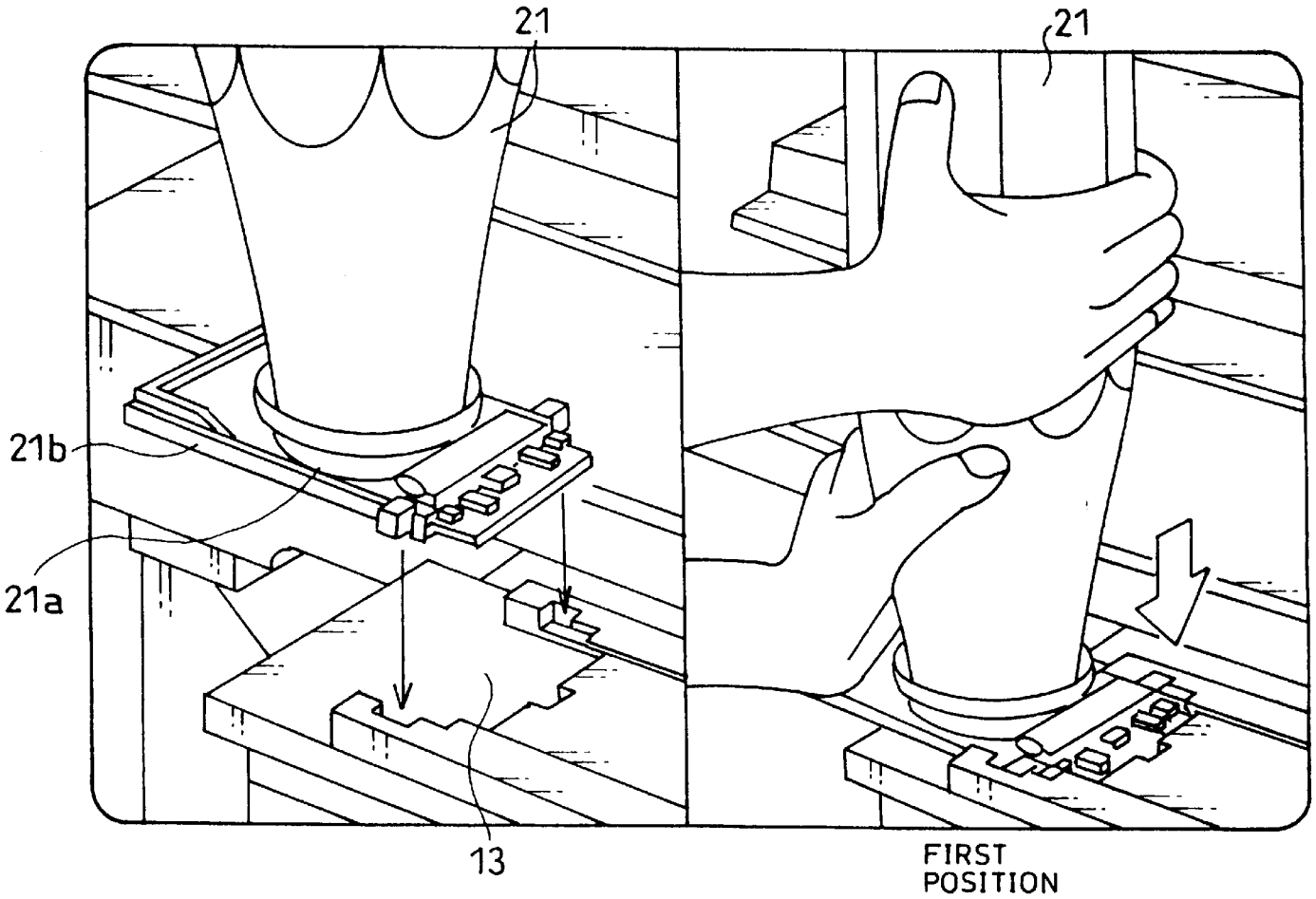
FIG. 4 is an explanatory drawing showing how to start attaching a toner bottle.
Figure 5:
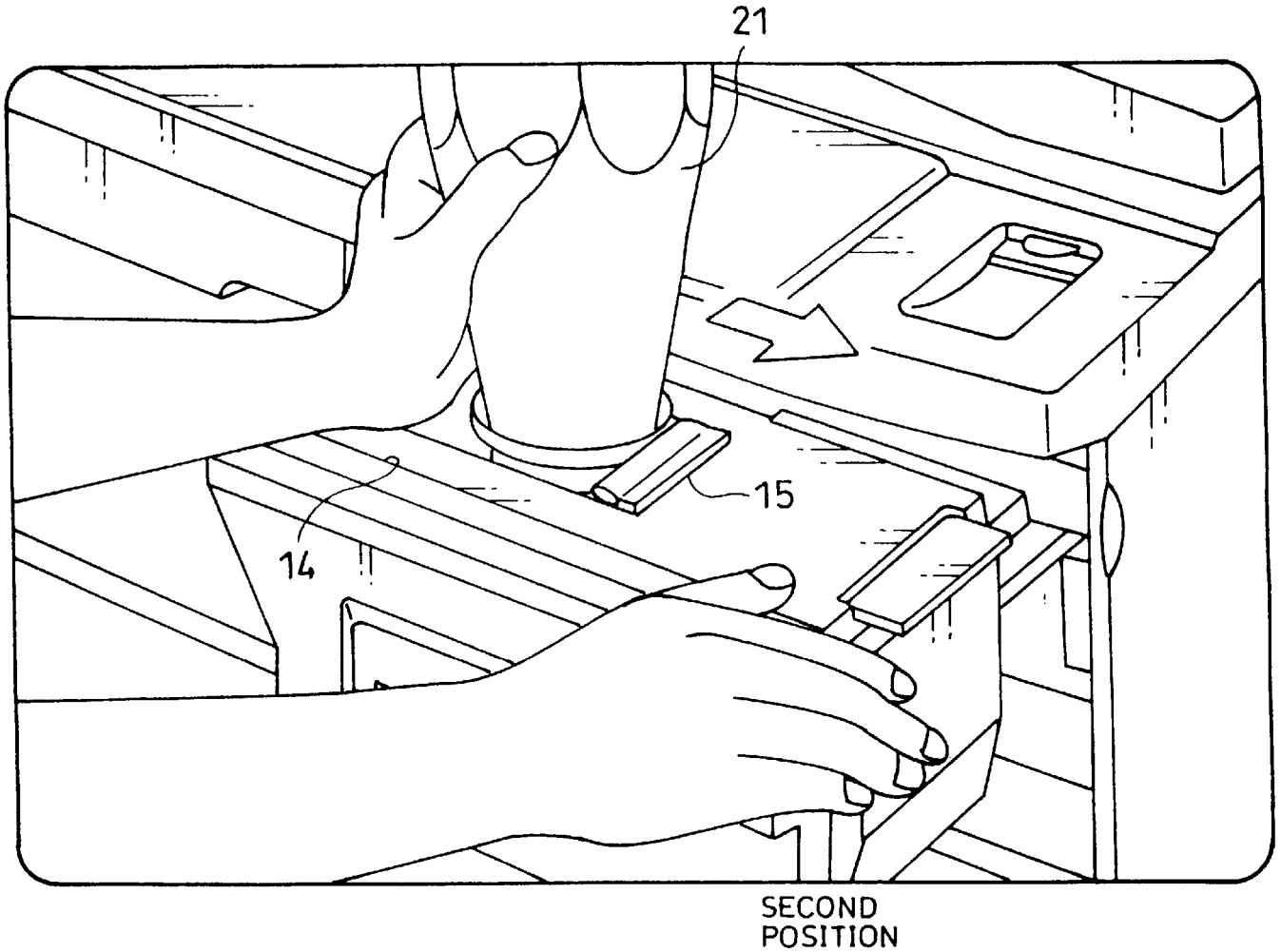
FIG. 5 is an explanatory drawing showing how to complete the attaching of a toner bottle.

As shown in FIG. 1, the toner bottle 21 is for refilling the toner hopper 4*b* in the developing device 4 with toner. A mount section for the toner bottle 21 is provided on the device main body and covered with a top lid 12 as shown in FIG. 3, for example. As shown in FIG. 4, the toner bottle 21 is mounted to a mount opening (first position) 13 where the toner outlet 21*a* is erected upside down (attaching started). The toner bottle 21 then is slid to a second position where the toner bottle 21 comes in contact with a stopper 15 (attaching completed), with a slide section 21*b* engaging with a guide groove 14 as shown in FIG. 5. At the second position, the toner is supplied to the toner hopper 4*b* as the toner outlet 21*a* is opened by removing, for example, a sealing cover from the toner bottle.

Figure 2:
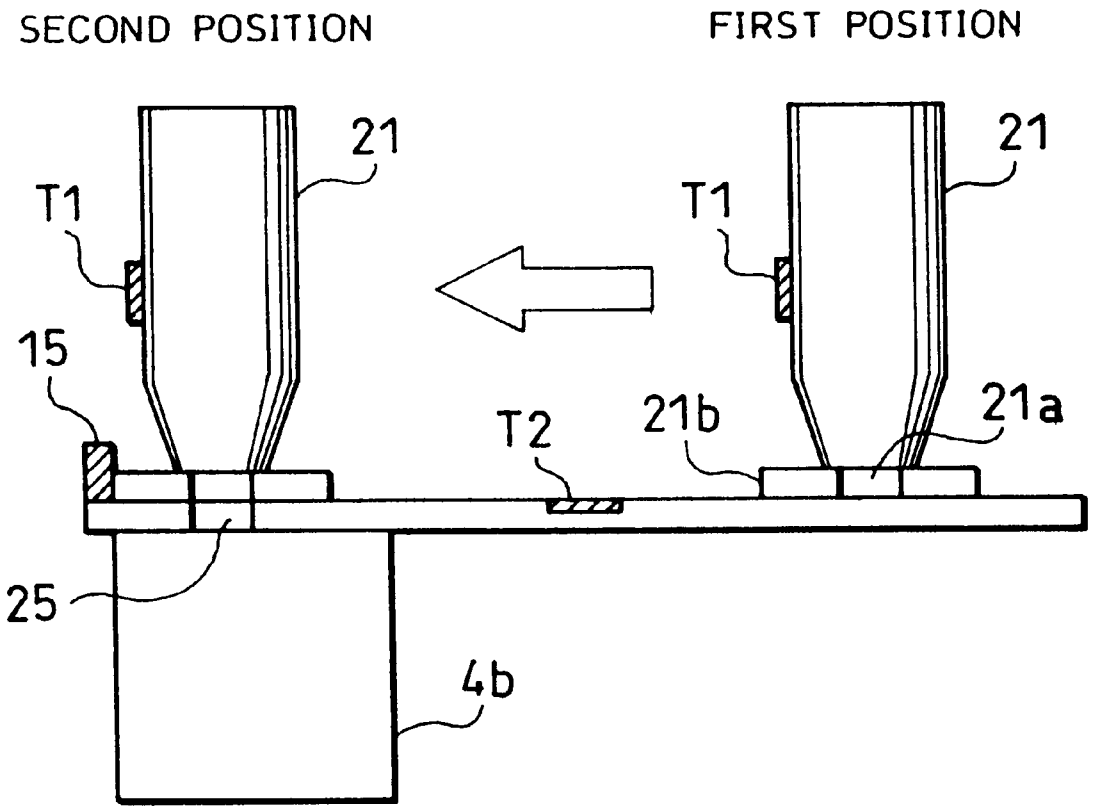
FIG. 2 is a cross-sectional view showing relative positions of bottle and a toner hopper when the toner bottle is attached to the image forming device illustrated in FIG. 1.

FIG. 2 is a cross-sectional view clearly showing relative positions of the toner bottle 21 and the toner hopper 4*b* during the attaching operation. The second position into which the toner bottle 21 slides from the first position is located right above the toner hopper 4*b*. The toner outlet 21*a* of the toner bottle 21 oppositely faces the toner inlet 25 of the toner hopper 4*b* at the second position. As the toner outlet 21*a* opens, the toner hopper 4*b* is filled with the toner. Further, as shown in FIG. 2, the toner bottle 21 has a communication device (container end communication means) on its side surface, and thereby enabled to transmit and receive information (to establish bidirectional communication) to and from a communication device (main body end communication device) T2 disposed between the first and second positions of the device main body.

Figure 6:
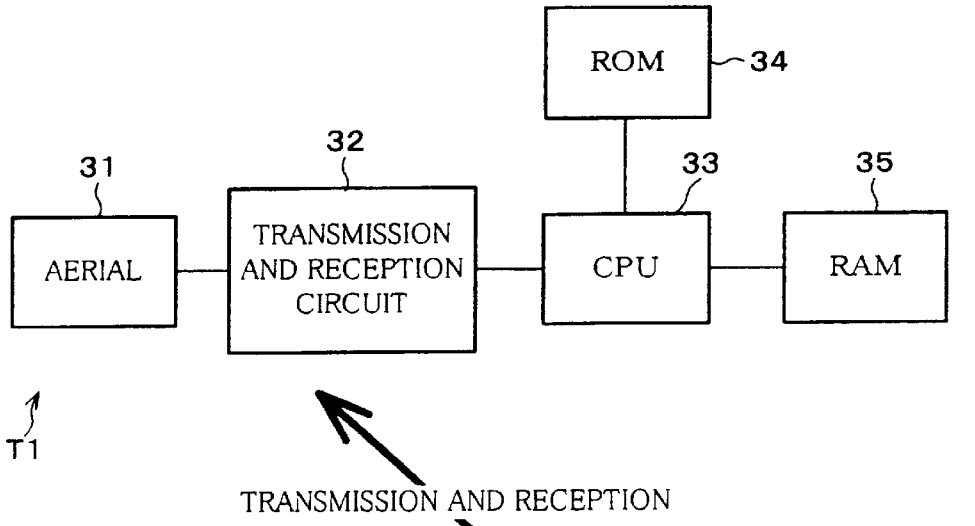
FIG. 6(*a*) is a block diagram showing an arrangement of a communication device T1.
Figure 6:
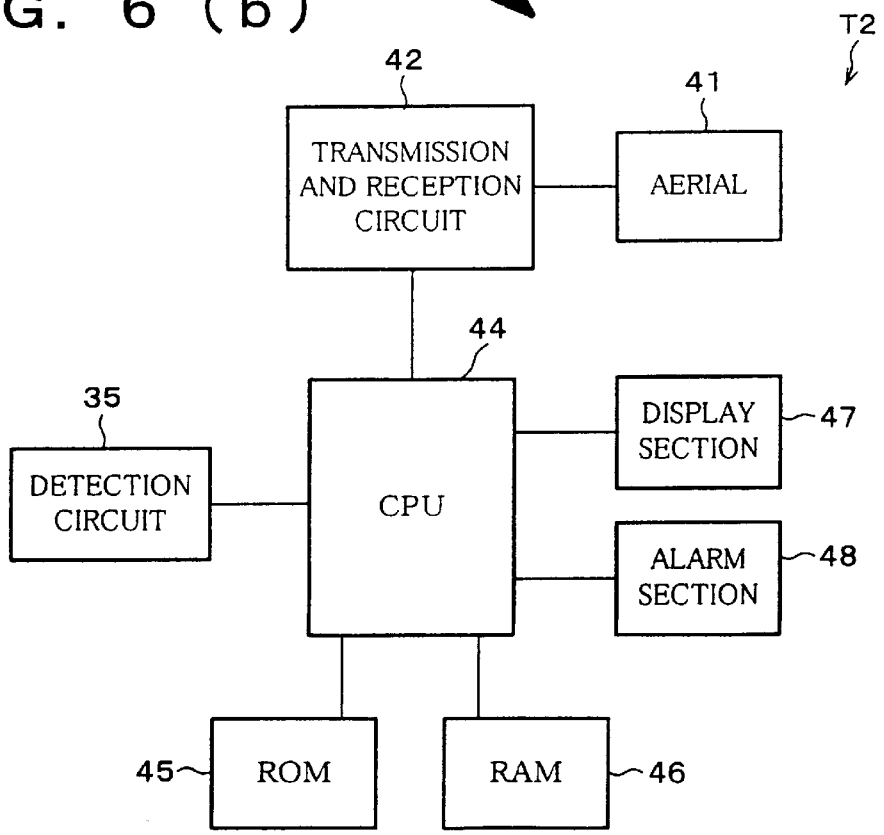

As shown in FIG. 6(*a*), the communication device T1 is constituted by an aerial 31, a transmission and reception circuit 32, a CPU 33, a ROM 34, and a RAM 35.

The RAM 35 is constituted by a ferroelectric memory (FRAM), storing information on the toner bottle 21. "Information" here includes, for example, a manufacturer code and serial number (product lot number) of the toner bottle 21, a name and type of compatible copying machines, printers, facsimiles, and other devices, and a color and developing, transfer, and fixing conditions for the toner contained in the toner bottle 21. A memory map is formed in the RAM 35 to store these pieces of information, as well as other pieces of information recorded as necessary during operation.

A ferroelectric memory is non-volatile, therefore superior in storing information on the toner bottle 21, and rewritable at fast rate in comparison with an EEPROM, a flash memory, and other non-volatile memories. These features of a ferroelectric memory greatly alleviates the workload of the CPU 33 that controls it. Further, the ferroelectric memory boasts a long life, because it is superior in rewriting durability, that is, rewritable more than $10^{12}$ times.

The transmission and reception circuit 32 is constituted by a transmission circuit for transmitting information retrieved as necessary from the RAM 35 via the aerial 31 in a predetermined encoding scheme and a reception circuit for decoding the electronic waves received via the aerial 31 to recover information that is then written into the RAM 35. Also, the transmission and reception circuit 32 has a function to receive electromagnetic waves transmitted by the communication device T2, and supply them as an electric power to the communication device T1.

By the programs stored in the ROM 34, the CPU 33 controls information flow, e.g., retrieves information stored in the RAM 35, writes information to the RAM 35, and transfers information inside the communication device T1, and also controls calculation based on the information. Further, the CPU 33 switches the transmission and reception circuit 32 between the transmission circuit and the reception circuit to control its transmission and reception operations as well as standby operations. Transmission of information, if continuously done after the transmission is started, is readily controllable, since the information is carried over continuous signals. By contrast, if transmission of information is done only intermittently, since signals are transmitted only intermittently, less electric power will be required. The user can make a choice on his own on which of the transmission mode should be used.

As shown in FIG. 6(*b*), the communication device T2 is constituted by an aerial 41, a transmission and reception circuit 42, a detection circuit 43, a CPU 44, a ROM 45, a RAM 46, a display section 47, and an alarm section 48.

The transmission and reception circuit 42 is constituted by a transmission circuit for transmitting information retrieved as necessary from the RAM 46 via the aerial 41 in a predetermined encoding scheme and a reception circuit for decoding the electronic waves received via the aerial 41 to recover information that is then written into the RAM 46. The detection circuit 43 transmits a detection signal to the CPU 44, as it detects the toner bottle 21 being attached in the first position in the image forming device 11 in an electrical, mechanical, or optical manner.

The display section (notification means) 47 is for displaying the progress and results of the bidirectional communication between the communication device T1 and the communication device T2 by means of characters or images on a display panel provided externally on the communication device T2. The alarm section (notification means) 48 is for warning the user by means of a human voice or an alarm sound using speakers provided externally to the communication device T2 when necessary, for example, during or after the bidirectional communication.

Receiving from the detection circuit 43 a detection signal representing that the toner bottle 21 has been attached to the first position, the CPU 44 controls information flow, e.g., retrieves information stored in the RAM 46, writes information to the RAM 46, and transfers information inside the communication device T2, and also controls calculation based on the information by the programs stored in the ROM 45. Further, the CPU 44 switches the transmission and reception circuit 42 between the transmission circuit and reception circuit to control its transmission and reception operations as well as standby operations. Also, the CPU 44 sends commands to control operations of the display section 47 and the alarm section 48. In addition, based on a result of bidirectional communication between the communication device T1 and the communication device T2, the CPU 44 determines whether or not the toner bottle 21 is suitable for the device main body. The CPU 44 has a further function as control means capable of specifying different image forming conditions depending on whether or not the toner bottle 21 is suitable.

Further, after completion of the refilling with the supplementary toner contained in the toner bottle 21, the CPU 44 controls the transmission and reception circuit 42 to transmit history information of the toner bottle 21 to the communication device T1 of the toner bottle 21. The history information may include, for example, the date that the supplementary toner is supplied, a message representing that the toner bottle 21 is empty, and the name and type of the device to which the supplementary toner is supplied. The communication device T1, as receiving the history information, writes it to the RAM 35. Hence, the information on the toner bottle 21 is kept updated.

The communication device T1 and the communication device T2, arranged as above, may be located anywhere; however, here, the aerials 31 and 41 are adjusted in terms of orientation and strength of electric waves in such a manner to enable the establishment of communication between the communication device T1 and the communication device T2 only when the toner bottle 21 is in proximity of the first position, during the move from the first position to the second position, and in proximity of the second position, so as to avoid transmission errors and jamming with other communication devices and to ensure transmission and reception of information related to the toner bottle 21.

The space between the first position and the second position is in many cases occupied by nothing else but the toner bottle 21 when it is to be attached, and serves no other purposes; transmission errors and jamming with other communication devices can be avoided and a highly reliable communication is ensured, if the bidirectional communication is carried out only in this space. When this is the case, the bidirectional communication established with the toner bottle 21 is smoothly carried out since the communication is established not only at specified points but covers the entire area in which the toner bottle 21 is movable. Further, if, for example, the toner bottle 21 is not properly mounted to the first position, a bidirectional communication is established before the toner bottle 21 reaches the second position; therefore, trouble, such as detection errors caused by failed communication, are avoidable.

This way, the toner bottle 21 is capable of establishing bidirectional wireless communication with the main body of the image forming device; the toner bottle 21 is therefore freed from those constraints on how it should be attached to the device main body so as to form an electric circuit between the toner bottle 21 and the device main body. Besides, the toner bottle 21 can be structured more simply, and thereby occupies a smaller space. The toner bottle 21 is further improved on durability if terminals (connectors), now rendered obsolete by the above arrangement, are omitted from the toner bottle 21. In addition, the wireless communication is not affected by possible contamination of the toner bottle 21 and the device main body with toner and other materials, and is automatically established when the toner bottle 21 is attached to the device main body, freeing the user from troublesome procedures.

The use of unsuitable products can be prevented in advance, if further arrangement is made so that the device main body determines based on the incoming information from the toner bottle 21 whether or not the toner bottle 21 to be attached is suitable and also that the operations from the establishment of bidirectional communication through the determination are completed before the supply of the supplementary toner is started at the second position. Moreover, the device main body can transmit any piece of information stored therein to the toner bottle 21; therefore, that piece of information, if stored as history information of the toner bottle 21, can be utilized effectively in recycling after the toner bottle 21 is collected. Especially, a toner bottle 21, once used, can be prevented from being forged into a bogus product. This way, the use of the RAM alone in the communication device T1 can prevent erroneous attaching as well as can provide storage for history information.

Figure 7:
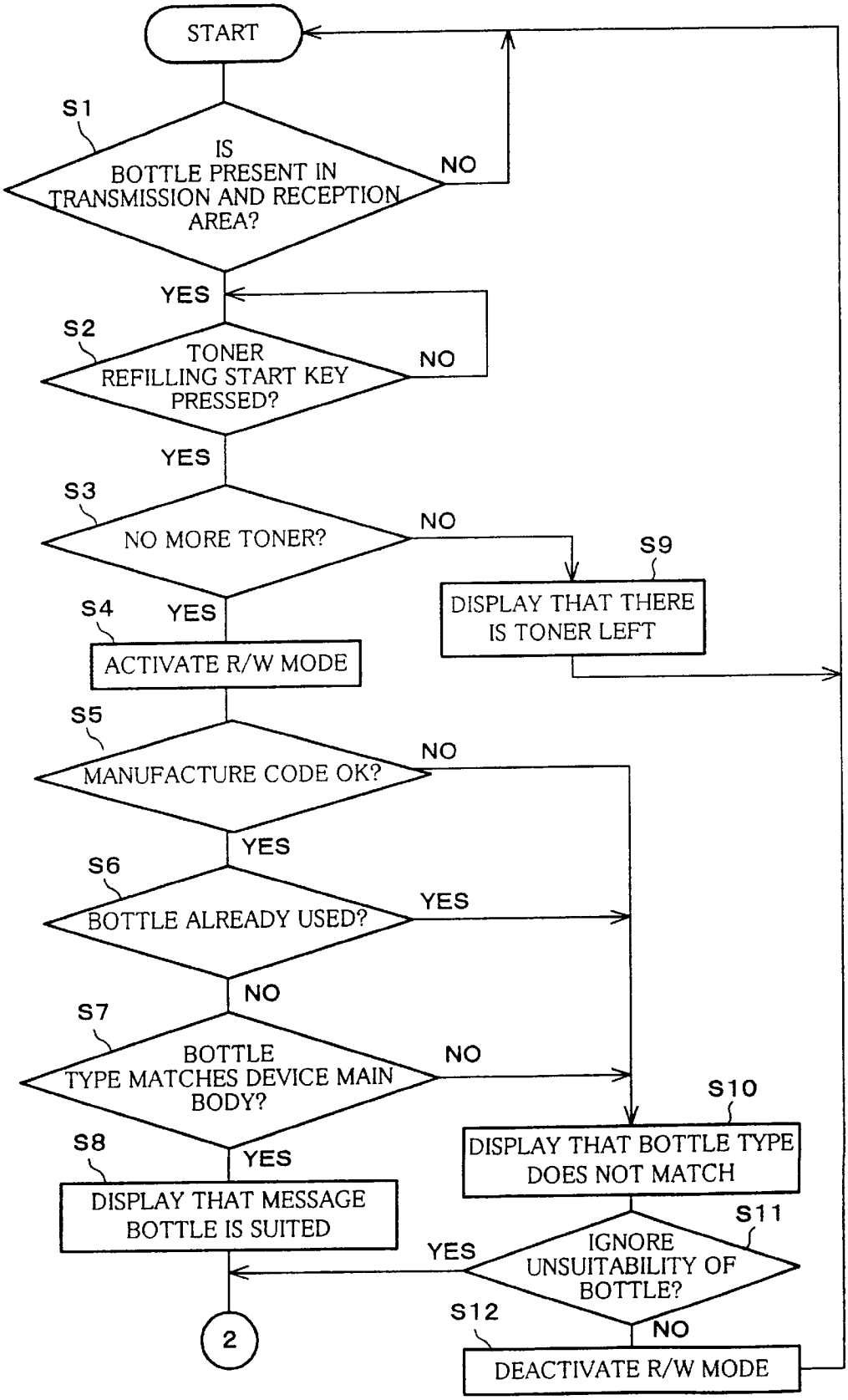
FIG. 7 is a flow chart showing a first half of a process to refill the image forming device illustrated in FIG. 1 with toner supplied from a toner bottle.
Figure 8:
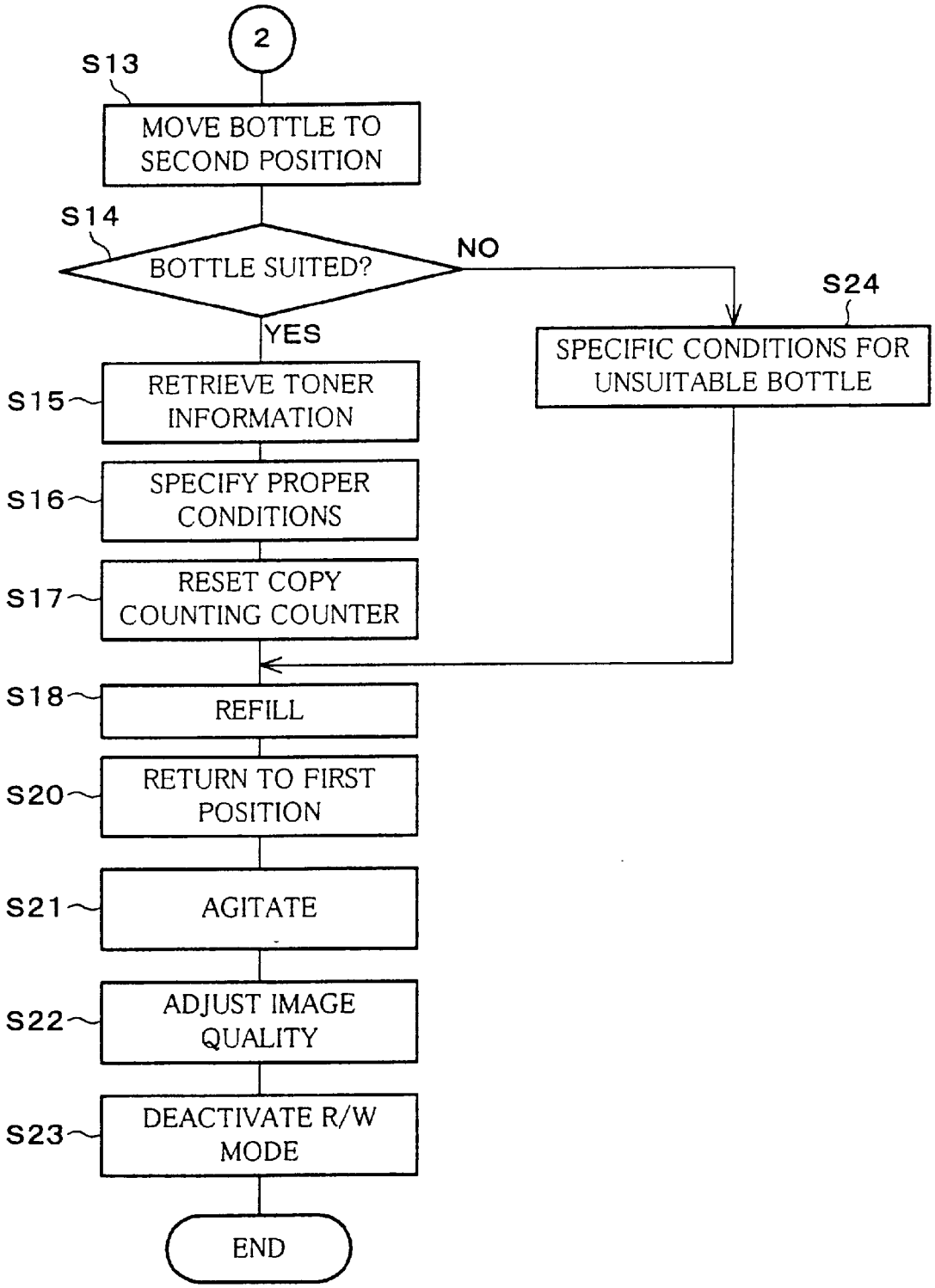
FIG. 8 is a flow chart showing a second half of the aforementioned process to refill the image forming device illustrated in FIG. 1 with toner supplied from a toner bottle.

Next, referring to the flow charts constituting FIG. 7 and FIG. 8, the following description will discuss operations by the image forming device 11 being refilled with toner in the foregoing arrangement. As the detection circuit 43 in the communication device T2 detects that the toner bottle 21 has been attached in the first position, the CPU 44 controls the transmission and reception circuit 42 to send electric waves to the communication device T1 to feed electric power. As the communication device T1 is fed with electric power, the communication device T1 responds to the communication device T2 by the transmission and reception circuit 32 notifying that the communication device T1 is ready to start communication.

Accordingly, first, in S1, based on whether or not the communication device T2 has received the response electric waves from the communication device T1, it is determined whether or not the toner bottle 21 to be attached has reached the aforementioned communicable area (the area from the first position through the second position). If the toner bottle 21 is in the communicable area, the process proceeds to S2. In response to a press on the toner refilling start key provided on the control panel (not shown) of the device main body, the device main body becomes prepared to start the toner refilling process, and displays on a display panel in the display section 47 a message whether or not the toner hopper 4b has toner left in it.

If it turns up in S3 that there is toner left, the process proceeds to S9 in which the display section 47 displays a message informing that there still is toner remaining, terminating the attaching of the toner bottle 21. By contrast, if it turns up that the toner hopper 4*b* is empty, the process proceeds to S4 in which the device main body changes to a mode whereby information can be written and retrieved (R/W mode).

In the device main body, as the communication device T2 receives the incoming information from the communication device T1 in the toner bottle 21, the CPU 44 determines sequentially in S5 through S7, based on that information, whether or not the manufacturer code is suitable (whether the toner bottle 21 carries a manufacturer code that coincides or is compatible with the manufacturer code of the device main body), whether or not the toner bottle 21 has been already used, and whether or not the product type matches the device main body. The criteria in the determination are a mere example, and may be varied according to the type of information stored in the RAM 35 in the communication device T1 as necessary.

If the toner bottle 21 has cleared all the criteria stipulated in S5 through S7, the process proceeds to S8 in which the display section 47 displays a message notifying that the toner bottle 21 is properly used with the device main body. If the toner bottle 21 has failed any of the criteria, the process proceeds to S10 in which the display section 47 displays a message notifying that the toner bottle 21 is not suitable for the device main 14 body. In the latter case, an enquiry is made in S11 whether or not the unsuitability of the toner bottle 21 should be ignored. If it is not to be ignored, the process proceeds to S12 where the R/W mode of the device main body is deactivated, and the attaching of the toner bottle 21 is suspended. If it is to be ignored, the process proceeds to subsequent steps. Alternatively, the alarm section 48 may be arranged to produce an alarming sound, for example, in place of, or in addition to, a display carried out by the display section 47.

The foregoing steps are executed before the toner bottle 21 reaches the second position, allowing the user to know suitability of the toner bottle 21 before the supplementary toner is actually supplied; therefore, the steps are important in determining what to do further with the toner bottle 21, for example, whether or not the refilling with toner is to be continued.

Subsequently, in S13, the toner bottle 21 slides to the second position. The present embodiment has the most prominent feature in that the image forming process that follows S13 varies depending on the suitability of the toner bottle 21. If the attaching is suspended as above when a message is displayed that the toner bottle 21 is unsuitable, toner is supplied only from toner bottles 21 that are suitable, whereby the user is assured to obtain optimal results from the device main body and the toner bottles 21. By contrast, if the user still needs to take a chance and single out the possibly bogus product contained in the unsuitable toner bottle, the user may ignore the displayed message on the unsuitability of the toner bottle and proceed to the image forming process as follows.

First, if it turns out in S14 that the toner bottle 21 is suitable, since the toner can be used to carry out the image forming process without any problems, the process proceeds to S15 in which the CPU 44 in the communication device T2 retrieves toner information from the incoming information transmitted from the communication device T1. The CPU 44 specifies image forming conditions (normal image forming conditions) that are suitable for the toner information in S16, and resets a counter for counting the number of copied sheets in S17. By contrast,. if it turns out in S14 that the toner bottle 21 is unsuitable, the process proceeds to S24, in which the CPU 44 in the communication device T2 specifies image forming conditions that match the unsuitable product, by selecting one of image forming conditions under which image quality is lowered in comparison to normal quality, stored in a memory (not shown) of the device main body, for example, according to a manner predetermined by the user.

Those low quality image forming conditions may be, for example, such that the photosensitive drum 1 is charged up to a higher value than normal when it is given negative charges or the light projector 3 is adjusted to project a smaller amount of light than normal, so as to increase the consumption of toner and thereby lower the brightness of the formed image as a whole. Another example is such that the fixing temperature of the fixing device 7 is set lower than normal so as to make it difficult for the toner to be fixed properly onto the transfer material P. The condition, regardless of which one is selected, is retrieved from the memory in the device main body in response to a selection signal from the CPU 44, and supplied to a control device (not shown) in the device main body.

If the former image forming condition is selected, the control device causes the output voltage from the high voltage supply source 2*b* in the main charging device 2 to increase by a predetermined amount, and further causes the voltage fed to a light emitting element, such as a laser diode, used in the light projector 3 to decrease by a predetermined amount. If the latter image forming condition is selected, the control device causes the voltage supplied to a heat source, such as a halogen lamp, used for the heating roller in the fixing device 7 to decrease by a predetermined amount. Alternatively, the former and latter image forming conditions may be applied concurrently.

As image forming conditions are determined either for a suitable product or for an unsuitable product as above, the process proceeds to S18 in which supplementary toner is supplied from the toner bottle 21 to the toner hopper 4*b* from which the CPU 44 then receives a signal representative of completion of the refilling of the toner hopper 4*b* with toner. Subsequently, in S19, the CPU 44 controls the transmission and reception circuit 42 in the communication device T2 to send information notifying that the toner bottle 21 is "already used" to the communication device T1 of the toner bottle 21 which subsequently writes the information as history information into the RAM 35 of the communication device T1.

Thereafter, in S20, the toner bottle 21 returns from the second position to the first position and removed from the device main body. Meanwhile, in the device main body, in S21, the supplementary toner supplied to the toner hopper 4*b* is agitated to achieve uniform density; in S22, image quality, such as contrast, is adjusted; and finally, in S23, the R/W mode is deactivated. This concludes the toner refilling operations and has the image forming device prepared for an image forming process.

Thereafter, if the toner bottle 21 is a suitable product, a normal image forming process is executed. If the toner bottle 21 is an unsuitable product, an image forming process is executed under selected conditions that are for use with toner of a lower quality as mentioned above.

According to one of the lower quality image forming conditions under which the toner is consumed in an increased quantity, the formed image has a lower level of brightness as a whole and inferior image quality than normal; this arrangement offers the user a second chance to recognize that the toner bottle 21 is an unsuitable product, if the user missed, prior to the supplementing, the display of the result of the decision whether the toner bottle is "suitable" or "unsuitable". Consequently, the device main body can be protected from damage and quick wearing due to erroneous use of an unsuitable product over a long period of time. Besides, if a bogus product including toner of poor properties is contained in an unsuitable product, since the quality of images formed using this toner is inferior by far to the quality of images formed using other unsuitable products, the bogus product can be readily singled out.

According to one of the lower quality image forming conditions under which the toner is difficult to be fixed properly onto the transfer material P, the toner peels off as the formed image is touched with a finger for example; therefore, the user is able to recognize that the toner bottle 21 is unsuitable. Consequently, the device main body can be protected from damage and quick wearing due to erroneous use of an unsuitable product over a long period of time. Besides, if a bogus product including toner of poor properties is contained in an unsuitable product, since the quality of images formed using this toner is inferior by far to the quality of images formed using other unsuitable products, the bogus product can be readily singled out.

A first image forming device in accordance with the present invention includes a device main body to which a supplementary toner container for supplying supplementary toner is attached in a freely attachable and detachable manner, wherein the supplementary toner container includes container end communication means, having a memory function to store, and another function to update, information at least on the supplementary toner container, for contactlessly communicating with main body end communication means disposed in the device main body to bidirectionally transmit the information, the image forming device is characterized in that at least a portion, of the supplementary toner container, including the container end communication means is movable from a first position where the supplementary toner container starts being attached to the device main body to a second position where the supplementary toner container is completely attached in readiness for toner refilling, and is able to carry out the bidirectional communication at least somewhere between the first position and the second position, and the image forming device includes control means for deciding from a result of the bidirectional communication whether or not the information on the supplementary toner container matches the device main body, and for specifying an image forming condition that varies depending on the decision whether or not the supplementary toner container is suitable.

According to the arrangement, the container end communication means in the supplementary toner container can bidirectionally communicate with the main body end communication means disposed in the device main body to transmit the information on the supplementary toner container when the portion, of the supplementary toner container, including the container end communication means is somewhere between the first position where the supplementary toner container starts being attached and the second position where the supplementary toner container is completely attached. "Information" here refers to, for example, a manufacturer code and serial number (product lot number) of the supplementary toner container, a name and type of compatible copying machines, printers, facsimiles, and other devices, and a color and developing, transfer, and fixing conditions for the toner contained in the supplementary toner container.

The space between the first position and the second position is in many cases occupied by nothing else but the supplementary toner container when it is to be attached, and serves no other purposes; transmission errors and jamming with other communication devices can be avoided and a highly reliable communication is ensured, if the bidirectional communication is carried out only in this space.

Further, the main body end communication means receives the information on the supplementary toner container from the container end communication means through the foregoing communication. Based on a result of the communication, the control means decides whether or not the supplementary toner container is suitable for the device main body, and specifies an image forming condition that varies depending on whether or not the supplementary toner container is suitable. Therefore, if the supplementary toner container is suitable, a normal image forming process is executable by specifying regular image forming conditions.

By contrast, if the supplementary toner container is an unsuitable product, the product can be readily discovered by specifying a lower quality image forming condition under which the image quality is lowered. Consequently, the device main body can be protected from damage and quick wearing due to erroneous use of an unsuitable product over a long period of time. Further, among unsuitable products, especially a bogus product, which is likely to cause a large degradation in image quality, can be singled out.

As a result, an image forming device can be offered with capabilities to prevent erroneous attaching of a supplementary toner container to a device main body in a highly reliable manner and also to single out bogus products.

A second image forming device in accordance with the present invention includes all the features of the arrangement of the first image forming device, and is characterized in that the container end communication means is able to carry out the bidirectional communication anywhere between the first position and the second position.

According to the above invention, the bidirectional communication is smoothly carried out since the communication is established not only at specified points but covers the entire area in which the supplementary toner container is movable. Further, if, for example, the supplementary toner container is not properly mounted to the first position, a bidirectional communication is established before the supplementary toner container reaches the second position; therefore, trouble, such as detection errors caused by failed communication, is avoidable.

A third image forming device in accordance with the present invention includes all the features of the arrangement of the first or second image forming device, and is characterized in that before the supplementary toner is supplied to the device main body from the supplementary toner container which is at the second position, the bidirectional communication is carried out so that the control means decides whether or not the information on the supplementary toner container matches the device main body.

According to the above invention, it is the second position where the supplementary toner container is completely attached. An operation is subsequently executed to supply the supplementary toner to the device main body; however, prior to that supplying, the main body end communication means retrieves the information on the supplementary toner container from the container end communication means through bidirectional communication so that the control means decides whether or not the information is suitable.

Consequently, the user is immediately informed of a decision on the suitability of the information; thereby, prior to supplying the supplementary toner, the user can decide what to do with the supplementary toner container that has turned out to be an unsuitable product. The user, for example, may suspend the attaching of the supplementary toner container.

A fourth image forming device in accordance with the present invention includes all the features of the arrangement of one of the first to third image forming devices, and is characterized in that the main body end communication means writes into the container end communication means a history on a predetermined operation carried out by the supplementary toner container in order to supply the supplementary toner.

According to the above invention, the main body end communication means transmits to the container end communication means the history on a predetermined operation carried out by the supplementary toner container so that the supplementary toner container supplies the supplementary toner and writes the history into the container end communication means. "History" here may refer to, for example, the date that the supplementary toner is supplied to the device main body, a message representing that the supplementary toner container is empty, and the name and type of the device to which the supplementary toner is supplied. Consequently, history can be utilized effectively as information in recycling after the supplementary toner container that has been used to supply the supplementary toner is collected. Especially, a supplementary toner container, once used, can be prevented from being forged into a bogus product.

A fifth image forming device in accordance with the present invention includes all the features of the arrangement of one of the first to fourth image forming devices, and is characterized in that if the control means decides that the supplementary toner container is unsuitable, the control means is able to specify an image forming condition under which toner is consumed in an amount that is either increased or decreased from a reference value by a predetermined amount.

According to the above invention, if the control means decides from a result of the bidirectional communication that the supplementary toner container is unsuitable, the control means is able to specify an image forming condition under which toner is consumed during an image forming process in an amount that is either increased or decreased from a reference value by a predetermined amount. For example, the image carrier is charged up to a higher value than normal when it is given negative charges or the image carrier is exposed to light in a smaller amount than normal, so as to increase the consumption of toner over a reference amount. This lowers the brightness of the formed image as a whole and enables the user to recognize that the supplementary toner container is an unsuitable product. Consequently, the device main body can be protected from damage and quick wearing due to erroneous use of an unsuitable product over a long period of time. Further, among unsuitable products, a bogus product containing toner of such poor properties that cause a large degradation in image quality can be singled out.

A sixth image forming device in accordance with the present invention includes all the features of the arrangement of one of the first to fifth image forming devices, and is characterized in that it further includes fixing means for fixing the toner formed image through heat, wherein if the control means decides that the supplementary toner container is unsuitable, the control means is able to specify an image forming condition under which a fixing temperature of the fixing means is decreased from a reference value by a predetermined amount.

According to the above invention, the image forming device is provided with fixing means for fixing the image, and if the control means decides from a result of the bidirectional communication that the supplementary toner container is unsuitable, the control means is able to specify an image forming condition under which a fixing temperature of the fixing means is decreased from a reference value by a predetermined amount. The arrangement makes it difficult for the toner to be fixed properly onto the transfer material when compared to a normal level. The toner peels off as the formed image is touched with a finger for example; therefore, the user is able to recognize that the supplementary toner container is unsuitable. Consequently, the device main body can be protected from damage and quick wearing due to erroneous use of an unsuitable product over a long period of time. Further, among unsuitable products, a bogus product containing toner of such poor properties that cause a large degradation in the fixing onto the transfer material can be singled out.

A seventh image forming device in accordance with the present invention includes all the features of the arrangement of one of the first to sixth image forming devices, and is characterized in that it further includes a notification means for, if the control means decides that the supplementary toner container is unsuitable, notifying the user of the decision through either a display or a sound, or both.

According to the above invention, if the control means decides that the attached supplementary toner container is unsuitable, the notification means notifies the user of the decision through either a display or a sound, or both. Consequently, for example, the user is better notified of the decision through visual recognition of characters or images provided that the device main body has a display panel or through audio recognition of a voice or a sound provided that the device main body has a speaker.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming device, comprising a device main body to which a supplementary toner container for supplying supplementary toner is attached in a freely attachable and detachable manner, wherein the supplementary toner container, includes container end communication means, having a memory function to store information at least on the supplementary toner container, for contactlessly communicating with main body end communication means disposed in the device main body to transmit the information, and at least a portion, of the supplementary toner container, including the container end communication means is movable from a first position where the supplementary toner container starts being attached to the device main body to a second position where the supplementary toner container is completely attached in readiness for toner refilling, and is able to carry out the communication at least somewhere between the first position and the second position, said image forming device comprising control means for deciding from a result of the communication whether or not the information on the supplementary toner container matches the device main body, and for specifying an image forming condition that varies depending on the decision whether or not the supplementary toner container is suitable.

2. The image forming device as set forth in claim 1, wherein the container end communication means has another function to update the information on the supplementary toner container and bidirectionally communicates with the main body end communication means.

3. The image forming device as set forth in claim 1, wherein the container end communication means carry out the communication anywhere between the first position and the second position.

4. The image forming device as set forth in claim 1, wherein before the supplementary toner is supplied to the device main body from the supplementary toner container which is at the second position, the communication is carried out so that the control means decides whether or not the information on the supplementary toner container matches the device main body.

5. The image forming device as set forth in claim 2, wherein the main body end communication means writes into the container end communication means a history on a predetermined operation carried out by the supplementary toner container in order to supply the supplementary toner.

6. The image forming device as set forth in claim 1, wherein if the control means decides that the supplementary toner container is unsuitable, the control means is able to specify an image forming condition under which toner is consumed in an amount that is either increased or decreased from a reference value by a predetermined amount.

7. The image forming device as set forth in claim 1, wherein if the control means decides that the supplementary toner container is unsuitable, the control means is able to specify an image forming condition under which image quality is lowered in comparison to normal quality.

8. The image forming device as set forth in claim 7, wherein if the control means decides that the supplementary toner container is unsuitable, the control means is able to specify an image forming condition under which brightness of an image formed as a whole is different from normal brightness.

9. The image forming device as set forth in claim 7, further comprising a photosensitive member on which an electrostatic latent image is formed correspondingly to an image, wherein if the control means decides that the supplementary toner container is unsuitable, the control means is able to specify an image forming condition under which the photosensitive member is charged to an electric potential that is either increased or decreased from a reference value by a predetermined amount.

10. The image forming device as set forth in claim 7, wherein if the control means decides that the supplementary toner container is unsuitable, the control means is able to specify an image forming condition under which the toner is fixed less properly onto a transfer material.

11. The image forming device as set forth in claim 1, further comprising fixing means for fixing the toner formed image through heat, wherein if the control means decides that the supplementary toner container is unsuitable, the control means is able to specify an image forming condition under which a fixing temperature of the fixing means is decreased from a reference value by a predetermined amount.

12. The image forming device as set forth in claim 1, further comprising notification means for, if the control means decides that the supplementary toner container is unsuitable, notifying the decision.

13. The image forming device as set forth in claim 12, wherein the notification means notifies the user of the decision through either a display or a sound, or both.

14. The image forming device as set forth in claim 1, wherein the supplementary toner container has a ferroelectric memory for storing the information at least on the supplementary toner container.

* * * * *